US005868687A

United States Patent [19]

Tedesco

[11] Patent Number: 5,868,687

[45] Date of Patent: Feb. 9, 1999

[54] CHAIR EQUIPPED WITH MASSAGE APPARATUS

[75] Inventor: Romeo Tedesco, Weston, Canada

[73] Assignee: Global Upholstery Company, Downsview, Canada

[21] Appl. No.: 874,509

[22] Filed: Jun. 13, 1997

[30] Foreign Application Priority Data

Jun. 5, 1997 [CA] Canada ..... 2207192

[51] Int. Cl.[6] ..... A61H 1/00; A61H 23/02

[52] U.S. Cl. ..... 601/49; 601/57; 601/56; 297/188.01

[58] Field of Search ..... 601/49, 56–61, 601/65, 66, 50–54, 63, 86, 69, 70, 90, 94, 98; 297/188.01, 188.14, 188.04, 188.2

[56] References Cited

U.S. PATENT DOCUMENTS

| | | | |
|---|---|---|---|
| Re. 34,381 | 9/1993 | Barnes | 24/590 |
| 2,579,305 | 12/1951 | Cushman | 155/116 |
| 2,653,648 | 9/1953 | Marshall | 155/25 |
| 2,863,494 | 12/1958 | Lautier et al. | 155/112 |
| 3,145,052 | 8/1964 | Morgan | 297/354 |
| 3,223,072 | 12/1965 | Bross | 120/42.03 |
| 3,368,845 | 2/1968 | Watanabe | 297/330 |
| 3,446,204 | 5/1969 | Murphy | 128/33 |
| 3,578,379 | 5/1971 | Taylor et al. | 297/71 |
| 3,678,923 | 7/1972 | Oetinger | 128/33 |
| 3,730,019 | 5/1973 | Ballard | 74/502 |
| 3,889,998 | 6/1975 | Weiland | 297/217 |
| 4,354,398 | 10/1982 | Porter | 74/501 |
| 4,559,929 | 12/1985 | Hseu | 128/33 |
| 4,595,237 | 6/1986 | Nelsen | 297/347 |
| 4,856,130 | 8/1989 | Berkovich | 5/109 |
| 4,916,968 | 4/1990 | Kabaya | 74/519 |
| 4,956,755 | 9/1990 | Maglica et al. | 362/206 |
| 5,020,517 | 6/1991 | Foster, Jr. et al. | 128/33 |
| 5,029,822 | 7/1991 | Selzer | 267/64.12 |
| 5,090,770 | 2/1992 | Heinrichs et al. | 297/347 |
| 5,106,159 | 4/1992 | Iwamoto | 601/61 |
| 5,113,851 | 5/1992 | Gamba | 128/33 |
| 5,188,096 | 2/1993 | Yoo | 128/33 |
| 5,247,925 | 9/1993 | Yamasaki et al. | 128/33 |
| 5,358,307 | 10/1994 | Shafer et al. | 297/188.01 X |
| 5,437,608 | 8/1995 | Cutler | 601/49 |
| 5,464,381 | 11/1995 | Wilson | 601/49 |
| 5,582,458 | 12/1996 | Wildt | 297/188.01 X |

FOREIGN PATENT DOCUMENTS

| | | | |
|---|---|---|---|
| 052 832 | 6/1982 | European Pat. Off. | A47C 1/024 |
| 208 127 | 1/1987 | European Pat. Off. | A47C 1/024 |
| 329 455 | 8/1989 | European Pat. Off. | A47C 1/024 |
| 41 14 101 | 5/1992 | Germany | A47C 1/024 |
| 338954 | 10/1936 | Italy | 297/188.01 |
| 405024467 | 2/1993 | Japan | B60N 2/22 |
| 406277126 | 10/1994 | Japan | A47C 1/024 |
| 7907059 | 4/1980 | Netherlands | A47C 1/022 |

*Primary Examiner*—Danton D. DeMille

*Attorney, Agent, or Firm*—Philp Mendes da Costa Bereskin & Parr

[57] ABSTRACT

A chair comprises a seat and a back rest. At least one vibrator is positioned in the seat and/or the back rest. The chair further comprises a housing for receiving a replaceable battery for powering the vibrator. A main power control is positioned so as to be accessible to a person when seated in the chair. A separate mobile controller, which includes controls for actuating the vibrator, is provided.

25 Claims, 4 Drawing Sheets

46
40
10
14
M7
M8
76
50
52
62
64
M5
18
M6
42
74
M3
M4
80
90
76
70
18
M1
48
M2
32
26
12
24
72
28
60
16
20
18

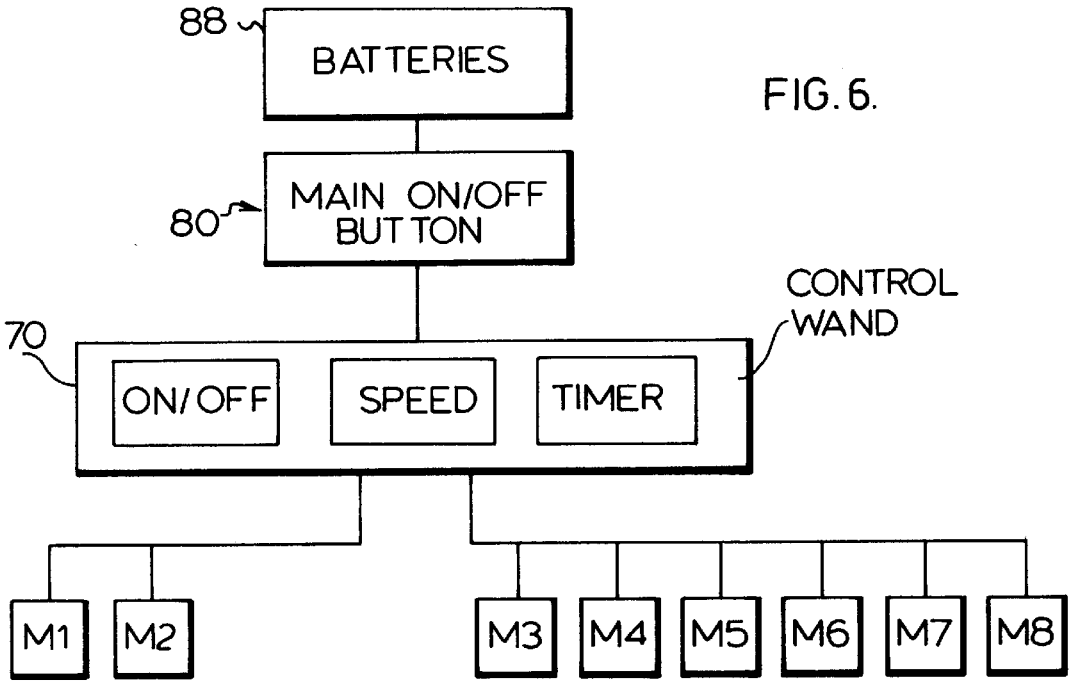
FIG. 6.
FIG. 7.
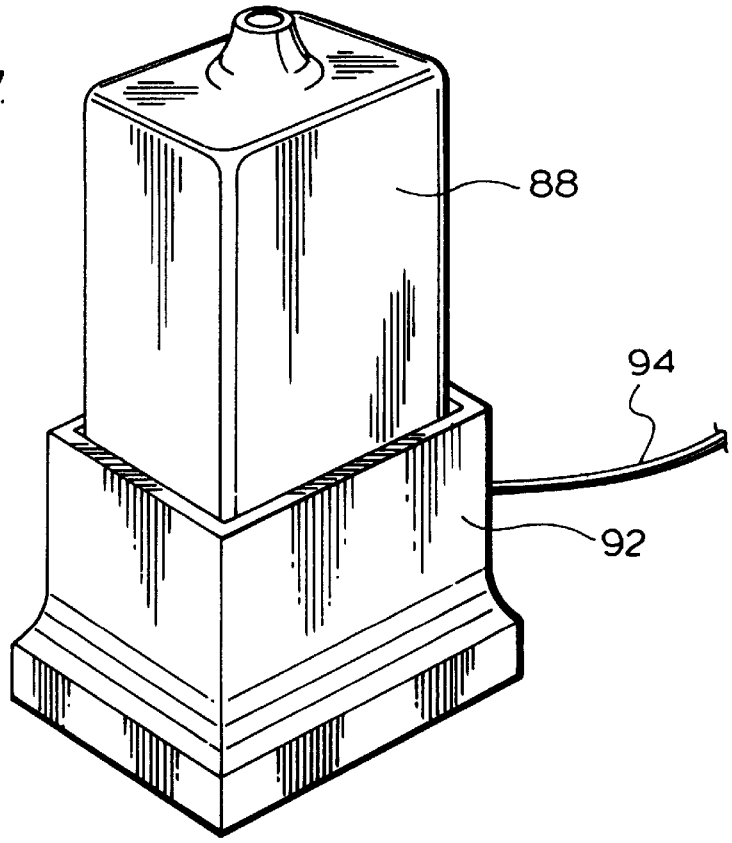

CHAIR EQUIPPED WITH MASSAGE APPARATUS

FIELD OF THE INVENTION

This invention relates to chairs which are equipped with an apparatus, such as vibrators, for providing a massage action for a person seated in a chair.

BACKGROUND OF THE INVENTION

Conventional office chairs are known in the art. A person may remain seated in an office chair, such as at a desk or at a work station, for many hours at a time. Many approaches have been taken to improve the long term comfort of such chairs. This includes improving the ergonomics of the chair and increasing the padding of the chair. A further approach which has been developed is to provide a motor for providing motion to all or a portion of a chair. For example, Gamba (U.S. Pat. No. 5,113,851) discloses a chair which includes a motor for rocking the seat of a chair. In contrast, Yamasaki et al (U.S. Pat. No. 5,247,925) discloses a chair which has included therein a vibration transmission device which is provided in the seat and the back rest of a chair for providing a massage action.

Massage pads and the like which can be placed on top of existing furniture or cars have also been developed. See for example Foster, Jr. et al (U.S. Pat. No. 5,020,517), Cutler (U.S. Pat. No. 5,437,608 and Yoo (U.S. Pat. No. 5,188,096).

It has also been known to include massage apparatus in lounge chairs for the home and the like. See for example Murphy (U.S. Pat. No. 3,446,204) and Oetinger (U.S. Pat. No. 3,678,923).

Lounge chairs and the like are typically bulky and are typically designed as a stationary piece of furniture. The massage apparatus for these chairs has generally been designed to be plugged directly into an AC outlet. When incorporating such devices into office chairs, it has also been considered to obtain power by using an electrical cord to connect the mechanised apparatus to an external source of power (see Yamasaki et al).

In order to provide a device which will customize the massage action to the requirement of a particular individual, massage devices typically come with a controller which is connected via an electric cord to the massage apparatus (see for example Foster, Jr. et al, Yoo and Cutler). However, when these devices are added to an office chair, the controller may be positioned so as to interfere with the other controls of the chair and, in addition, may interfere with the regular use of the chair.

SUMMARY OF THE INVENTION

In accordance with the instant invention there is provided a chair comprising a support surface; at least one vibrator positioned in the support surface; a housing for receiving a replaceable battery for powering the at least one vibrator; a main power control accessible to a person seated in the chair; and, a separate mobile controller including controls for actuating the at least one vibrator, the controller being moveable between a storage position in which the controller is positioned so as not to interfere with the customary use of the chair when a person is seated in the chair and an operating position in which the controls of the controller may be adjusted when a person is seated in the chair.

In accordance with another embodiment of the invention, there is provided a chair comprising a seat member, a back rest member and an arm rest member; a plurality of vibrators positioned in at least one of the seat member and the back rest member; a housing for receiving a replaceable battery for powering the vibrators; a main power control positioned in the arm rest member; and, a separate mobile controller including controls for actuating the vibrators, the controller being moveable between a storage position in which the controller is positioned so as not to interfere with the customary use of the chair when a person is seated in the chair and an operating position in which the controls of the controller may be adjusted when a person is seated in the chair.

In accordance with a further embodiment of the invention, there is provided in combination, a massage device comprising a chair comprising, a seat member and a back rest member and base adapted for movement across a floor; at least one vibrator positioned in at least one of the seat member and the back rest member; a housing for receiving a rechargeable battery for powering the at least one vibrator; a main power control accessible to a person seated in the chair; and, a separate mobile controller including controls for actuating the at least one vibrator, the controller being moveable between a storage position in which the controller is positioned so as not to interfere with the customary use of the chair when a person is seated in the chair and an operating position in which the controls of the controller may be adjusted when a person is seated in the chair; a rechargeable battery; and, a recharger for a rechargeable battery.

The chair may also include a retainer for receiving and storing the controller in the storage position. The retainer may comprise a male engagement member. In such an embodiment, a mating female engagement member is provided on the controller, especially the back of the controller. The male and female engagement members preferably comprise velcro™.

In an alternate embodiment, the retainer may comprise a housing which is sized to receive all or a portion of the controller therein. The housing may be provided in one of the side surfaces of the seat or the back rest member of the chair. Alternately, the housing might be provided on the lower surface of the seat or the rear surface of the back rest member. The housing for the replaceable battery may be similarly positioned.

The chair disclosed herein provides a compact design for including a massage apparatus in a chair. The chair may be operated by a replaceable battery (preferably a rechargeable battery). Accordingly, the chair may be freely movable within an office environment without concern as to the location of an external power source to which the chair must be attached. The battery may be conveniently located and easily removable from the chair, even while a person is seated in the chair. When the battery requires replacement, the user merely removes the battery from the housing and places it, for example, in a recharger, in the case of a rechargeable battery.

A further advantage of the instant application is that the chair includes a controller which may be operated by the user when seated in the chair. Accordingly, the user may personalize the massage action which suits their particular needs or requirements. Once these parameters have been set, the controller may be conveniently stored out of the way. When the massage is required, the user may easily actuate the preset massage features by actuating the main power control which may be conveniently located, for example, in the arm of a chair.

Accordingly, the instant chair provides in total a unique combination of a massage apparatus for a chair which may be fully customized but which may be operated by the touch of a button.

BRIEF DESCRIPTION OF THE DRAWINGS

These and other advantages of the instant invention will be more fully and completely understood with reference to the following description of a preferred embodiment of the invention in which:

FIG. 6 is a schematic wiring diagram for the chair of FIG. 1; and,

FIG. 7 is a perspective view of the recharger and battery of the chair of FIG. 1.

DESCRIPTION OF THE PREFERRED EMBODIMENT

Figure 1:
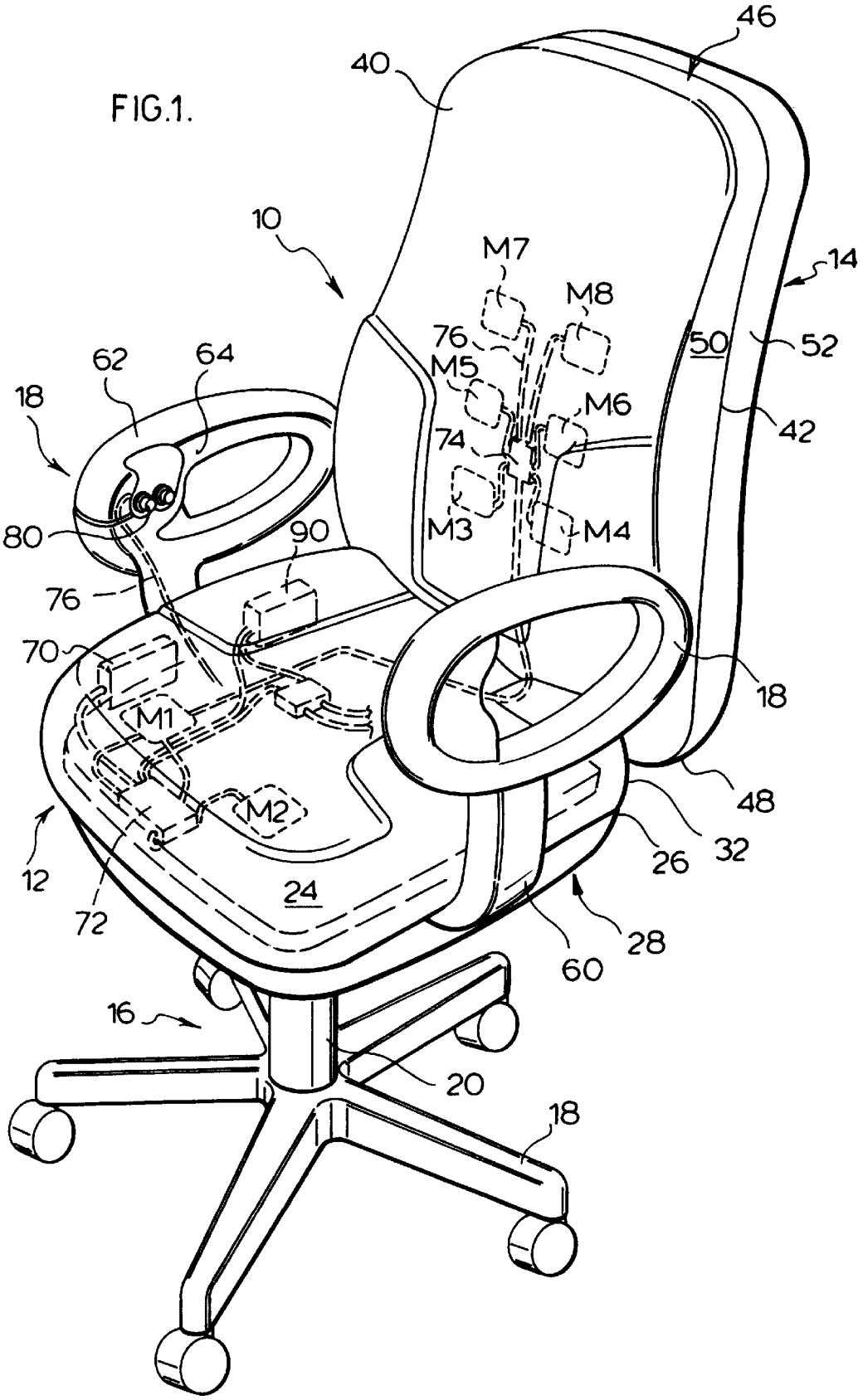
FIG. 1 is a perspective view of a chair according to the instant invention.

As shown in FIG. 1, chair 10 has seat 12, back rest 14, base 16 and arms 18.

Chair 10 may be any chair known in the art. Preferably, chair 10 is an office chair for use at a desk, work station or the like. Accordingly, preferably, base 16 comprises a wheeled base 18 and a upright support member 20 which extends from wheeled base 18 to seat 12 and supports seat 12 above wheeled base 18. As shown in FIG. 1, wheeled base 18 includes a plurality of wheels or casters to enable chair 10 to be moved across the floor on which it is situated. In a preferred embodiment, base 16 may be constructed by an means known in the art which would adapt chair 10 to be moved easily across a floor on which it is situated. Further, support member 20 may include a cylinder, such as a pneumatic cylinder, with an appropriate control mechanism, which would allow the height of seat 12 to be adjusted for a particular user.

Figure 2:
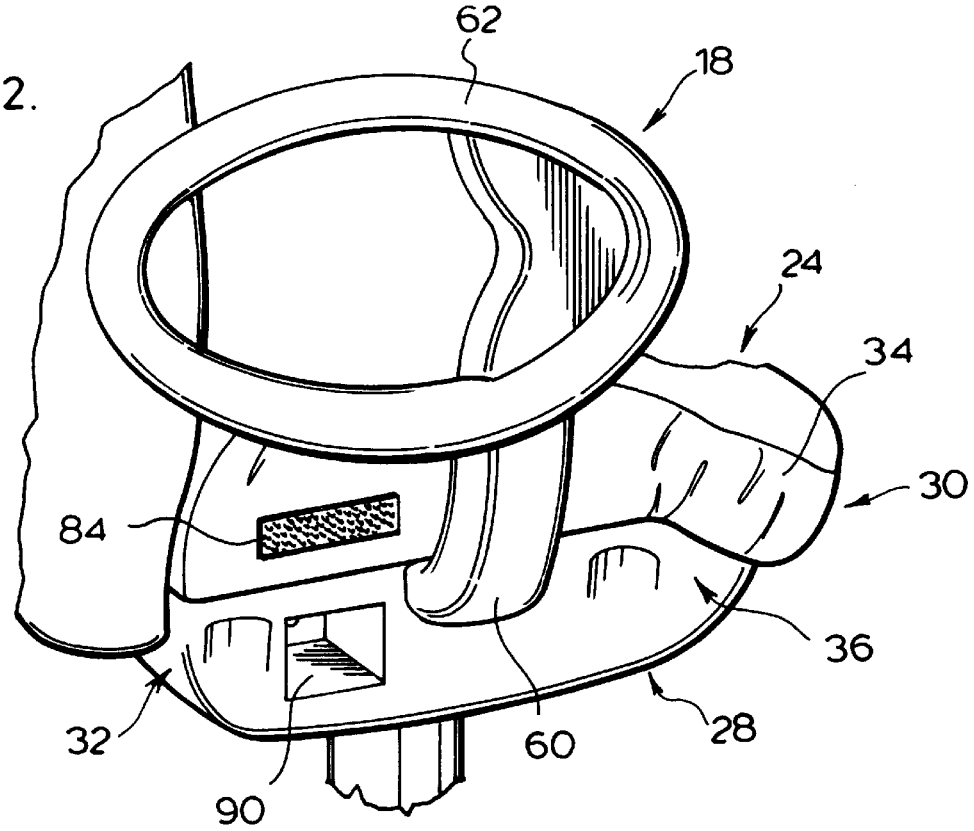
FIG. 2 is a side view of the chair of FIG. 1 showing the housing for the battery and the retainer.
Figure 3:
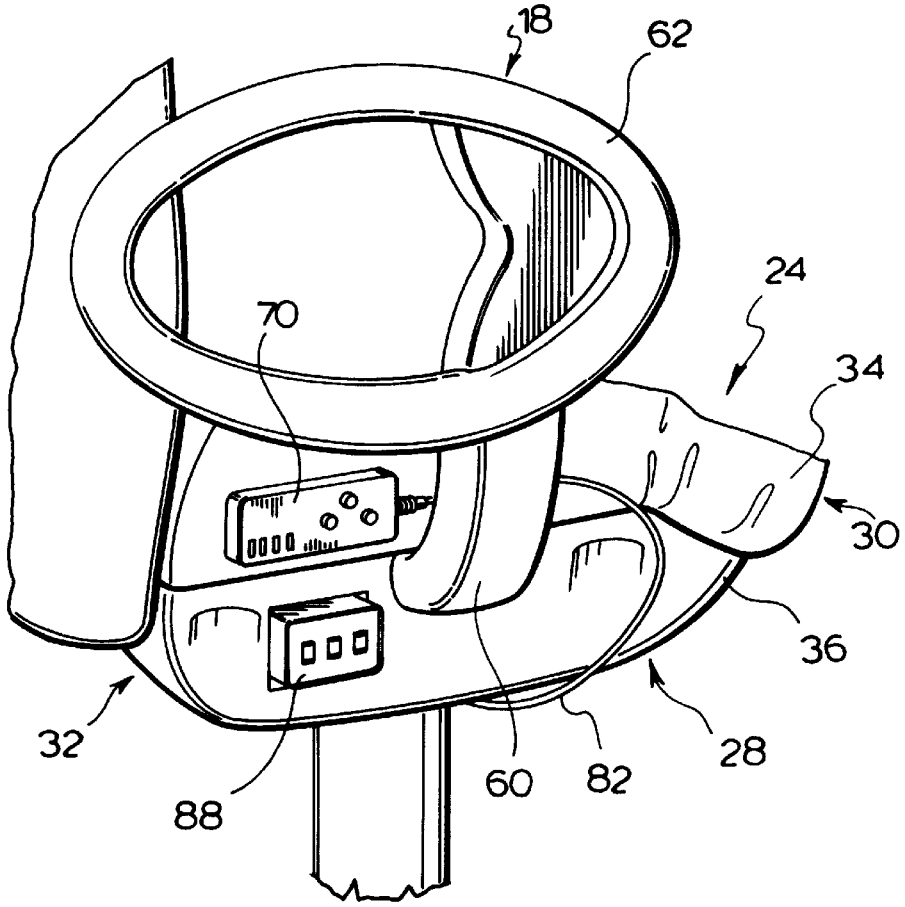
FIG. 3 shows the side view of FIG. 2 with the controller and the battery in their storage positions.
Figure 4:
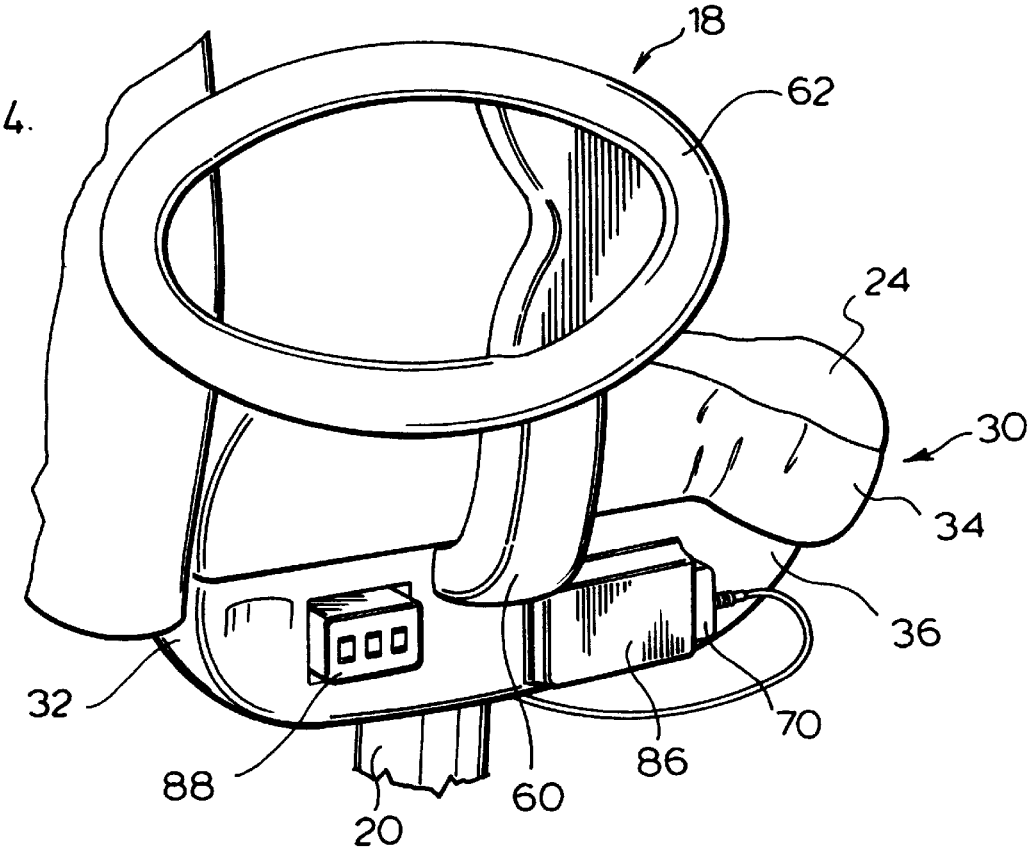
FIG. 4 is an alternate embodiment of the view of FIG. 3.

Seat 12 has a top surface 24, side surfaces 26, bottom surface 28, front surface 30 and rear surface 32 (see FIG. 1). Seat 12 may be of any particular shape or configuration known in the art. Typically, as shown in FIGS. 2–4, seat 12 comprises upper portion 34 which provides a comfortable seating area for a person and lower portion 36 which includes means for mounting seat 12 on base 16, and various movement control mechanisms (e.g. control means for pivoting or rocking seat 12 with respect to base 16, means for pivoting back rest 14 with respect to chair 12 and other such means as are known in the art). Upper portion 34 is generally padded and may be constructed from foam, springs and the like. Lower portion 36 may be surrounded by a plastic casing or shroud which provides a housing for receiving the mounting means and the various movement control mechanisms for chair 10.

Back rest 12 has a front surface 40, side surfaces 42, rear surface 44, upper surface 46 and lower surface 48 (see FIG. 1). As with seat 12, back rest 14 may be shaped and configured in any style known in the art. Back rest 14 may include padding to providing a comfortable back rest for a person seated in chair 10. In some cases, various apparatus may be included in the back rest member. For example, back rest 14 may include mounting means for mounting back rest 14 to chair 10 or movement control mechanisms, eg. means for permitting back rest 14 to rock with respect to seat 12. Back rest 14 may include any such features as may be desired. In some cases, back rest 14 is constructed to have a first portion 50 and a rear portion 52. Front portion 50 is a padded member and may be constructed from foam and other materials known in the art. Rear portion 52 may comprise a housing, such as a plastic shroud, in which the mounting means and the movement control mechanisms may be positioned and on which front portion 50 is mounted.

It will be appreciated that, in some instances, it may be desired to construct a chair without a back rest 14 and this invention includes such an embodiment.

In the preferred embodiment, chair 10 includes at least one arm 18 and, more preferably two arms 18, one positioned adjacent each side 26 of seat 12. Arm 18 may be of any particular design known in the industry and may be mounted to chair 10 by any means known in the industry. As shown in the Figures attached hereto, arm rest 18 may comprise a generally vertically extending support member 60, and arm rest portion 62 having an inner surface 64.

According to the instant invention, chair 10 has incorporated at least one device for creating a massage action in the chair. Generally, such units comprise mechanized units which vibrate or include a rotating member to produce a motion which is detected by a person seated in the chair. Pursuant to the instant invention, any such device as known in the art may be used. An examples of such devices is the PULSOR IV™ manufactured by J.B. Research, Inc. Preferably, such massage units (or vibrators) which are incorporated into chair 10 are relatively thin. Seat 12 and back rest 14 are preferably sufficiently thick so that a person would not feel the vibrators when seated in a chair but would only detect their motion. Accordingly, seat 12 and back rest 14 preferably have sufficient padding so that the vibrators will not be felt by a user when seated in chair 10.

Referring to FIG. 1, chair 10 is shown having two vibrators positioned in seat 12 of chair 10 (designated M1 and M2) and six vibrators positioned in back rest 14 of chair 10 (designated M3, M4, M5, M6, M7 and M8). It will be understood that seat 12 and back rest 14 may be provided with any desired number of vibrators. According to the instant invention, at least one vibrator is provided in a support surface (i.e. seat 12 or back rest 14) of chair 10. Preferably, a plurality of vibrators are provided. More preferably, a plurality are provided in seat 12 and a plurality are provided in back rest 14. As shown in FIG. 1, vibrators M1 and M2 are positioned adjacent front surface 30 of seat 12 so as to provide a massage type action to the upper legs of a user. Vibrators are positioned in back rest 14 to provide a massage type action to the mid to lower region of the back of a person (including the lumbar region).

In one embodiment, it may be desirable to individually actuate each vibrator M1–M8. Further, it may desirable to actuate vibrators M1–M8 in a particular sequence or to vary the intensity of the motion provided by each of the vibrators M1–M8. In order to facilitate such an embodiment, the massage apparatus may accordingly incorporate a control means for sending individual signals to vibrators M1–M8 such as circuit board 72 in seat 12 and circuit board 74 in back rest 14. The vibrators (M1–M8), circuit boards 72 and 74 and controller 70 are connected together by wires 76 which are shown in dashed outline in FIG. 1.

Figure 5:
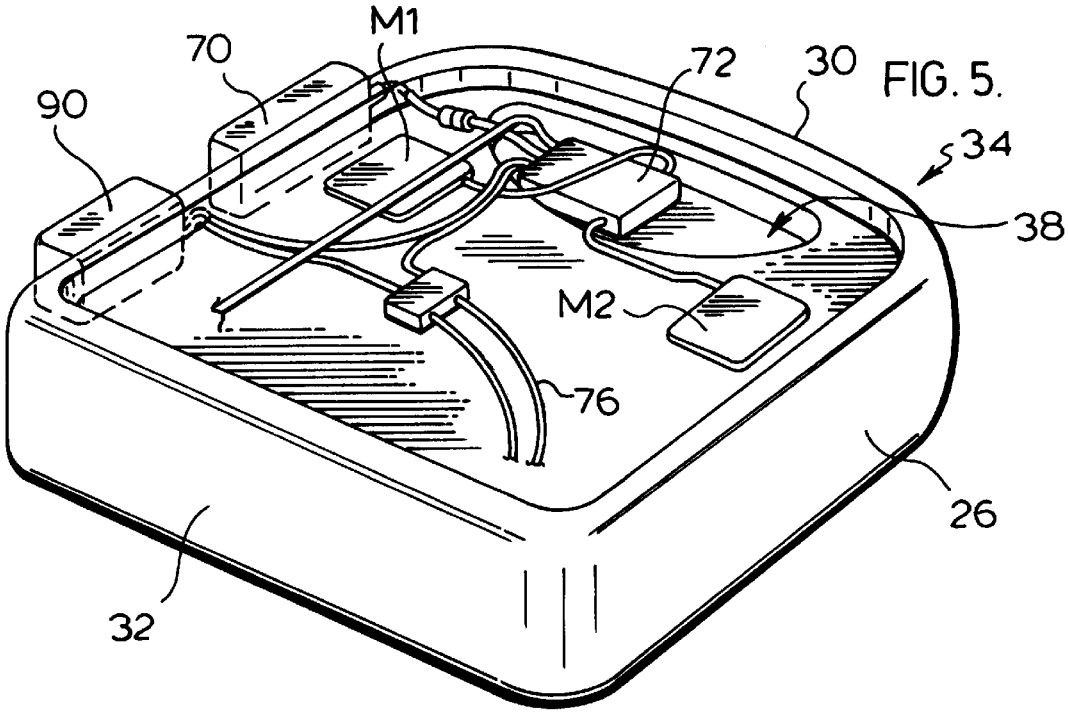
FIG. 5 is a bottom view of the seat of the chair of FIG. 1.

As shown in FIG. 5, upper portion 34 of seat 12 may have a recess 38 provided therein. If upper portion 34 comprises foam, recess 38 may be a cavity provided in the foam. Recess 38 provides a location in seat 12 where circuit board 72 may be placed and insulated by the foam from damage due the forcers which are exerted when a person sits in seat 12. Preferably, recess 38 is located distal to the central portion of seat 12, such as at the forward portion of seat 12. Alternately, circuit boards 72 and 74 may be positioned in lower portion 36 of seat. Wires 76 may be placed at any desired location in chair 10 but are preferably incorporated within chair 10 so as not to be visible.

As shown in FIG. 6, controller 70 may include an on/off switch to actuate the vibrators. In addition, it may include controls to adjust various features of vibrators M1–M8 such as the speed (or intensity) of the vibrators or other such features which are known in the art. Controller 70 may also include for example a timer which would control the duration of the massage action once the circuit is initiated. Examples of such apparatus are known in the art including Cutler.

Chair 10 is provided with main power control 80. Main power control 80 will typically have an on position and an off position. Accordingly, main power control 80 may be a control button which may move longitudinally between an outward off position and an inward on position. Main power control 80 may be positioned in arm 18 of chair 10 and, preferably, main power control 80 is positioned on inner surface 64 of arm rest portion 62. Alternately, main power control 80 may be positioned so as to be accessible to a person seated in the chair. As such, main power control 80 may be positioned, for example, along side surface 26 of seat 12 or side surface 42 of back rest 14. In such a position, main power control 80 may be actuated by a user when comfortably seated in the chair without unduly bending or leaning in any particular direction.

As shown in FIG. 6, the controller or control wand 70 includes an on/off switch. This is a typical feature of controllers. In such an embodiment of this invention, the on/off switch of controller 70 may be left in the on position at all times. Main power control 80 is wired in series with controller 70 so that, when main power control 80 is actuated, the massage action is initiated. In another embodiment, it will be appreciated that controller need not incorporate an on/off switch. Further, the massage apparatus may be wired so that the massage action is initiated when main power control 80 is moved to the on position regardless of the position of the on/off switch of controller 70. Preferably main power control 80 is connected so that wires 76 are hidden from view, such as by running wires 76 through a bore provided in arm 18 (not shown).

A particular feature of the invention is the mobility of controller 70. Controller 70 includes features for customizing the control action of chair 10. Accordingly, controller 70 is generally relatively large due to the number of controls which might be positioned thereon. Controller 70 is movable between a storage position in which the controller is positioned so as not to interfere with the customary use of chair 10 when a person is seated in the chair and an operating position in which the controls of the controller may be adjusted when a person is seated in a chair.

Referring to FIGS. 2 and 3, controller 70 may be connected by wire 82 to the remainder of the massage apparatus as shown in FIG. 5. Preferably, the storage position for controller 70 is positioned so as to be accessible to a person when seated in the chair. Accordingly, the person, when seated in the chair may be able to easily reach controller 70 and, with the massage apparatus operating, set the massage to their particular specifications. The controller may then be stored out of the way of the user as the controller will not be required to actuate the massage action of the chair. Accordingly, the controller may be stored along side surface 26 of seat 12, bottom surface 28 of seat 12, side surface 42 of back rest 14 or rear surface 44 of back rest 14. As shown in FIG. 3, controller 70 is stored on side 26 of seat 12.

Controller 70 may be so stored by various means. For example, as shown in FIG. 2, a male engagement member 84 may be positioned on side 26 of seat 12. A mating female engagement member may be positioned, for example, on the rear surface of controller 70 (not shown). The male and female engagement members may be velcro™. Accordingly, once the settings on controller 70 have been adjusted to the specifications of a user, controller 70 may easily be stored by placing controller 70 against male engagement member 84 thus securing controller 70 in its storage position. Alternately, as shown in FIG. 4, housing 86 may be provided for receiving therein all or a portion of controller 70. This embodiment may be employed, for example, if the lower portion of seat 12 is a plastic shroud. Housing 86 may then be moulded directly into the plastic shroud or applied, e.g. by glue, once the shroud has been manufactured.

Massage apparatus is preferably powered by means of battery 88. In this preferred embodiment, chair 10 is adapted to receive battery 88. Battery 88 is a replaceable power source and, accordingly, it is not necessary to have an electrical cord extending from chair 10 to an external power source, such as an AC outlet. Preferably, battery 88 is a rechargeable battery. More preferably, battery 88 is a NiCad battery.

Battery 88 is received in a housing 90. Housing 90 may be of any particular design or configuration which is adapted to receive battery 88. Further, housing 90 may be positioned at any location on chair 10 which would not interfere with the customary use of the chair when a person is seated in the chair. Preferably, housing 90 is located in side 26 of seat 12, bottom surface 28 of seat 12, side surface 42 of back rest 14 or rear surface 44 of back rest 14. In such a location, the battery may be easily accessed by a person. Preferably, battery 88 is positioned so as to be accessible to a person when seated in a chair. Accordingly, at the end of the day, or when battery 88 requires replacing, a person, while seated in the chair, may easily grasp battery 88 and remove it from housing 90. If battery 88 is rechargeable, battery 88 may then be placed in recharger 92. Recharger 92 is connected to a power source by electrical cord 94.

In operation, a user may first seat themselves in chair 10. They may then use controller 70 to set the required intensity, duration, sequence or such other parameters which may be available to customize the massage action of the vibrators. To do this, the user would actuate main power control 80 and, if required, the on/off switch on controller 70. Once the desired massage settings have been set, controller 70 may then be stored in the storage position, such as shown in FIGS. 3 and 4. The user may then switch off the massage action by means of main power control 80. If controller 70 has an on/off switch, the switch is preferably left in the on position when controller 70 is placed in the storage position. Once this initial set up has been conducted, the user may then actuate the preset massage settings merely by actuating main power control 80 which is easily located within reach of the user while seated in a chair.

It will be appreciated by those skilled in the art that various modifications and alterations of the apparatus as disclosed herein are possible and all are within the scope of this application. For example, the position of the massage apparatus (including the circuit boards, the wiring and the vibrators) may be adjusted. Further, controller 70 need not be hard wired to the massage apparatus. For example, it could operate as a wireless control unit.

I claim:

1. A chair comprising:

(a) a support surface;

(b) at least one vibrator positioned in the support surface for imparting a vibratory motion to a user when seated in the chair;

(d) a mobile controller including controls for adjusting the character of the vibratory motion, the controller being moveable between a storage position in which the controller is positioned so as not to interfere with the customary use of the chair when a person is seated in the chair and an operating position in which the controls of the controller may be adjusted when a person is seated in the chair; and, (e) a main hand operated power control accessible to a person seated in the chair, the main power control mounted in a housing other than the mobile controller.

2. The chair as claimed in claim 1 further comprising a housing for receiving a replaceable battery for powering the at least one vibrator.

3. The chair as claimed in claim 2 wherein the controller further comprises a cable extending between the chair and the controller and having a length to permit the controller to be operated while a person is seated in the chair.

4. The chair as claimed in claim 2 further comprising a wheeled base and the support surface is positioned above the wheeled base.

5. The chair as claimed in claim 1 further comprising a retainer for receiving and storing the controller in the storage position.

6. The chair as claimed in claim 5 wherein the retainer comprises a housing sized for receiving therein the controller.

7. The chair as claimed in claim 5 further comprising a seat member and a back rest member, the seat member having a lower surface and a side surface, the back rest member having a rear surface and a side surface, and wherein the retainer is positioned on one of the lower surface of the seat member, the side surface of the seat member, the rear surface of the back rest member and the side surface of the back rest member.

8. The chair as claimed in claim 7 further comprising a housing for receiving a replaceable battery for powering the at least one vibrator and wherein the housing for receiving a replaceable battery is positioned on one of the lower surface of the seat member, the side surface of the seat member, the rear surface of the back rest member and the side surface of the back rest member.

9. The chair as claimed in claim 5 wherein the retainer comprises a male engagement member and a mating female engagement member is provided on the controller.

10. A chair comprising:

(a) a seat member, a back rest member and an arm rest member;

(b) a plurality of vibrators positioned in at least one of the seat member and the back rest member;

(c) a housing for receiving a replaceable battery for powering the vibrators;

(d) a main power control positioned in the arm rest member; and, (e) a separate mobile controller including controls for one or more of adjusting the intensity of motion imparted by each of the vibrators, selecting which of the vibrators are activated and the sequence of activation of the vibrators, the controller being moveable between a storage position in which the controller is positioned so as not to interfere with the customary use of the chair when a person is seated in the chair and an operating position in which the controls of the controller may be adjusted when a person is seated in the chair.

11. The chair as claimed in claim 10 further comprising a retainer for receiving and storing the controller in the storage position.

12. The chair as claimed in claim 11 wherein the retainer comprises a male engagement member and a mating female engagement member is provided on the controller.

13. The chair as claimed in claim 12 wherein the male and female engagement members comprise hook and pile fasteners.

14. The chair as claimed in claim 11 wherein the retainer comprises a housing sized for receiving therein the controller.

15. The chair as claimed in claim 11 wherein the seat member has a lower surface and a side surface and the retainer is positioned on one of the lower surface and the side surface.

16. The chair as claimed in claim 15 wherein the housing for receiving a replaceable battery is positioned on one of the lower surface and the side surface of the seat member.

17. The chair as claimed in claim 11 wherein the controller further comprises a cable extending between the chair and the controller and having a length to permit the controller to be operated while a person is seated in the chair.

18. In combination, a massage device comprising:

(a) a chair comprising:

(i) a seat member and a back rest member and base adapted for movement across a floor;

(ii) at least one vibrator positioned in at least one of the seat member and the back rest member;

(iii) a first housing for receiving a rechargeable battery for powering the at least one vibrator;

(iv) a main hand operated power control mounted in a second housing and accessible to a person seated in the chair; and, (b) a rechargeable battery for providing power to the at least one vibrator; and, (c) a recharger for a rechargeable battery; and, (d) a mobile controller distinct from the second housing and including controls for adjusting the characteristics of the power which is delivered to the at least one vibrator, the controller being moveable between a storage position in which the controller is positioned so as not to interfere with the customary use of the chair when a person is seated in the chair and an operating position in which the controls of the controller may be adjusted when a person is seated in the chair.

19. The chair as claimed in claim 18 further comprising a retainer for receiving and storing the controller in the storage position.

20. The chair as claimed in claim 19 wherein the retainer comprises a male engagement member and a mating female engagement member is provided on the controller.

21. The chair as claimed in claim 20 wherein the male and female engagement members comprise hook and pile fasteners.

22. The chair as claimed in claim 19 wherein the retainer comprises a housing sized for receiving therein the controller.

23. The chair as claimed in claim 19 wherein the seat member has a lower surface and a side surface and the retainer is positioned on one of the lower surface and the side surface.

24. The chair as claimed in claim 23 wherein the housing for receiving a rechargeable battery is positioned on one of the lower surface and the side surface of the seat member.

25. The chair as claimed in claim 19 wherein the controller further comprises a cable extending between the chair and the controller and having a length to permit the controller to be operated while a person is seated in the chair.

* * * * *